US007892364B2

(12) United States Patent
Baba et al.

(10) Patent No.: US 7,892,364 B2
(45) Date of Patent: Feb. 22, 2011

(54) SURFACE MODIFYING JIG OF ENGINE VALVE AND SURFACE MODIFYING METHOD EMPLOYING IT

(75) Inventors: Tadao Baba, Tochigi-ken (JP); Takahiro Yamaguchi, Shimotsuke (JP); Masanori Kosugi, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 822 days.

(21) Appl. No.: 11/666,888

(22) PCT Filed: Mar. 24, 2006

(86) PCT No.: PCT/JP2006/006036

§ 371 (c)(1),
(2), (4) Date: May 2, 2007

(87) PCT Pub. No.: WO2006/109540

PCT Pub. Date: Oct. 19, 2006

(65) Prior Publication Data

US 2007/0277911 A1 Dec. 6, 2007

(30) Foreign Application Priority Data

Mar. 30, 2005 (JP) ..... 2005-096620

(51) Int. Cl.
*C23C 8/36* (2006.01)

(52) U.S. Cl. ..... 148/222

(58) Field of Classification Search ..... 148/222
See application file for complete search history.

(56) References Cited

U.S. PATENT DOCUMENTS 6,602,353 B1 8/2003 Kanbe et al.

FOREIGN PATENT DOCUMENTS

| | | | |
|---|---|---|---|
| JP | 57-159537 | A | 10/1982 |
| JP | 1-230762 | A | 9/1989 |
| JP | 8-35053 | A | 2/1996 |
| JP | 9-302457 | A | 11/1997 |
| JP | 3553549 | B2 | 5/2004 |
| JP | 2004-204355 | A | 7/2004 |

OTHER PUBLICATIONS

"jig." Dictionary.com Unabridged (v 1.1). Random House, Inc. Mar. 8, 2008. <Dictionary.com http://web.archive.org/web/20080308153640/http://dictionary.reference.com/browse/jig>.*

* cited by examiner

*Primary Examiner*—Roy King
*Assistant Examiner*—Jessee R. Roe
(74) *Attorney, Agent, or Firm*—Birch, Stewart, Kolasch & Birch, LLP

(57) ABSTRACT

A surface modifying jig of an engine valve comprising a substantially circular ring portion for holding the valve head of an engine valve, a head holding portion having a diameter decreasing gradually downward from the inner circumferential side of the ring portion, and a stem holding portion formed below the head holding portion with a substantially constant diameter. When plasma nitriding is performed, the valve head comes into annular line contact with the ring portion and being held by the head holding portion while kept in annular plane contact therewith, and a valve stem is held by the stem holding portion while kept in annular plane contact therewith.

9 Claims, 14 Drawing Sheets

SURFACE MODIFYING JIG OF ENGINE VALVE AND SURFACE MODIFYING METHOD EMPLOYING IT

TECHNICAL FIELD

The present invention relates to a surface-modifying jig for an engine valve, which is used for applying a surface-modifying treatment to an engine valve of an internal combustion engine. The present invention also concerns a surface modifying method employing such a jig.

BACKGROUND ART

An internal combustion engine has an engine valve for opening and closing intake and discharge ports. The engine valve comprises a circular head that closes the intake port or the discharge port, and a rod stem, which is connected to the head and held by a cylinder head of the internal combustion engine. The stem part of the engine valve slidingly moves quickly with respect to the cylinder head in order to open and close the intake and discharge ports. Thus, a surface-modifying treatment, such as a nitriding treatment, is applied to the engine valve in order to improve abrasion resistance.

Known nitriding treatments for engine valves include a gas nitriding method in which the engine valve is heated in an ammonia gas atmosphere, a salt bath nitriding (tuftriding) method in which the engine valve is salt-bathed with a mixed salt containing sodium cyanate or potassium cyanate, and a plasma nitriding method (ion nitriding) in which the engine valve is continuously irradiated with a plasma.

For example, when a plasma nitriding treatment is applied to an engine valve formed from an iron group series alloy, the engine valve first is set on a grid portion of a specimen stand, which serves as a surface-modifying jig. Incidentally, the engine valve has a spontaneously-generated passivation film (oxide film) on the surface thereof, wherein the passivation film impedes progress of the nitriding treatment. For this reason, the passivation film is removed by hydrogen-sputtering prior to the nitriding treatment. Then, a hardened layer is formed on the surface of the engine valve by applying a continuous plasma nitriding treatment to the engine valve (e.g., see Patent Document 1).

Patent Document 1: Japanese Patent No. 3553549

Disclosure of The Invention

In the prior art, according to Patent Document 1, the specimen stand comprises a frame having a rectangular grid portion. In this case, when an engine valve is set on the grid portion, contact portions between a circular head portion of the engine valve and the rectangular grid portion are dotted on the grid portion. That is, a point-to-point contact is formed between the head part and the grid portion. Thus, when a plasma nitriding treatment is applied to the engine valve, because of the small area of contact, excess voltage is applied locally to the contact portions between the head and the grid portion, and thus discharged surface roughness may occur disadvantageously on the contact portions of the head part due to such excess voltage. Similarly, in the specimen stand, damage due to melting or the like may occur disadvantageously on the contact portions of the head part, due to such excess voltage.

Also, when a plasma nitriding treatment is performed while the specimen stand is not in contact with the engine valve, glow discharges are generated in an overlapping manner on the specimen stand and on the engine valve. Thus, discharged surface roughness, melting damage or the like may occur on portions where such overlapping discharges occur.

In this case, the engine valve surface becomes irregular due to melting, peeling, etc., and the hardened layer formed on the engine valve surface may detrimentally develop a non-uniform thickness.

It is a general object of the present invention to provide a surface-modifying jig for an engine valve, which is used to apply a surface-modifying treatment to the engine valve.

A main object of the present invention is to provide a surface-modifying jig for an engine valve, wherein a nitriding treatment, or the like, can be applied to the engine valve to form a hardened layer on the engine valve having a uniform thickness.

Another object of the present invention is to provide a surface-modifying method in which a surface-modifying treatment can be applied stably to an engine valve.

Still another object of the present invention is to provide a surface-modifying method in which a hardened layer with uniform thickness can be formed on an engine valve.

According to an embodiment of the present invention, there is provided a method for surface-modifying an engine valve, comprising the steps of:

setting an engine valve formed of an iron group series alloy on a surface-modifying jig, thereby bringing at least one of a head part and a rod part of the engine valve into contact with the surface-modifying jig, the contact being at least one of a line contact and a surface contact; and placing the surface-modifying jig inside a treatment furnace, and causing a discharge between a cathode and an anode in the presence of a flowing gas, thereby generating a plasma employing the gas as a source, wherein the surface-modifying jig or the engine valve serves as the cathode.

Incidentally, the term "line contact" means a state in which a contact area extends linearly or along a curved line. The term "surface contact" means a state in which respective surfaces are in contact with each other.

With the present invention, the engine valve is held such that at least one of a head part and a rod part of the engine valve is brought into line contact or surface contact with the surface-modifying jig. This provides a larger contact area between the engine valve and the surface-modifying jig, compared to the case in which the engine valve is merely in point contact with the surface-modifying jig. Thus, when a surface-modifying treatment is applied to an engine valve that is set on the surface-modifying jig, the voltage applied during discharge between an anode and the surface-modifying jig or the engine valve (cathode) can be dispersed widely over the contact area between the engine valve and the surface-modifying jig, thereby preventing the voltage from being applied locally to the contact area.

As a result, it is possible to prevent surface roughness or the like caused by discharge on the engine valve, which occurs when overlapping glow discharges are generated, or when excess voltage is applied to the contact area between the engine valve and the surface-modifying jig. In this way, it is possible to prevent surface irregularities on the engine valve, which result from the surface roughness or the like. Therefore, a stable surface-modifying treatment can be applied to the engine valve, so that a hardened layer having a substantially uniform thickness can be formed on the surface of the engine valve by applying a nitriding treatment thereto, for example. The surface-modifying treatment may also include a hydrogen-sputtering and a plasma nitriding treatment.

Also, at least one of a hydrogen-sputtering and a nitriding treatment is performed on an engine valve in the presence of the generated plasma, and thus, when hydrogen-sputtering is performed, it is possible to remove a passivation film (oxidation film) generated on the surface of the engine valve. Meanwhile, when the plasma nitriding treatment is performed, it is also possible to stably form a hardened layer having a uniform thickness on the surface of the engine valve. Incidentally, the plasma-nitriding treatment may be performed immediately after hydrogen-sputtering has been performed, or the plasma-nitriding treatment may be performed concurrently with hydrogen-sputtering.

Further, the engine valve is set on the surface-modifying jig such that the head part of the engine valve is brought into surface contact with an inclined portion of the surface-modifying jig, which is inclined in accordance with the shape of the head part. In this case, since the contact area between the engine valve and the surface-modifying jig is large, compared to the case where the engine valve merely is placed in point contact with the surface-modifying jig, when a discharge, for example, is generated for surface-modifying the engine valve, it is possible to prevent application of excess voltage to the contact area, as well as to prevent overlapping of glow discharges between the surface-modifying jig and the engine valve. As a result, a stable surface-modifying treatment can be performed on the engine valve.

Furthermore, the engine valve is set on the surface-modifying jig such that the head part of the engine valve is brought into line contact with a ring portion of the surface-modifying jig, wherein the ring portion is formed to be annular in accordance with the shape of the head part. In this case, when a discharge is generated for surface-modifying the engine valve, it is possible to prevent overlapping of glow discharges as well as application of excess voltage to the contact area between the surface-modifying jig and the engine valve. As a result, a stable surface-modifying treatment can be performed on the engine valve.

Still further, the engine valve is set on the surface-modifying jig such that an outer circumferential surface of the rod part of the engine valve is placed in surface contact with a cylinder portion of the surface-modifying jig, wherein the cylinder portion has a shape in accordance with the shape of the rod part. In this case, when a discharge is generated for surface-modifying the engine valve, it is possible to prevent overlapping of glow discharges as well as application of excess voltage to the contact area between the surface-modifying jig and the engine valve. As a result, a stable nitriding treatment can be performed on the engine valve.

An anode may be located in the treatment furnace, or the treatment furnace itself may be used as an anode. In this case, since all that is housed in the treatment furnace is the surface-modifying jig and the engine valve, the surface-modifying jig and the engine valve can advantageously be located more flexibly within the treatment furnace. That is, it is possible to effectively utilize the space inside the treatment furnace.

According to another embodiment of the present invention, there is provided a surface-modifying jig for an engine valve, wherein the surface-modifying jig holds the engine valve, which is formed of an iron group series alloy, while performing a nitriding treatment on the engine valve, the surface-modifying jig comprising a holder for holding the engine valve in contact with at least one of a head part and a rod part of the engine valve, the contact comprising at least one of a line contact and a surface contact.

According to the present invention, since the surface-modifying jig is provided with a holder, which holds an engine valve such that the surface-modifying jig is brought into line contact or surface contact with at least one of a head part and a rod part of the engine valve, the contact area between the engine valve and the surface-modifying jig can be enlarged, as compared to the case where the engine valve merely is placed in point contact with the surface-modifying jig.

Thus, when a nitriding treatment, for example, is applied to the engine valve that is set on the surface-modifying jig as mentioned above, the discharge voltage between a treatment furnace in which the surface-modifying jig is located and the surface-modifying jig or the engine valve can be dispersed widely over the area of contact between the engine valve and the surface-modifying jig, thereby preventing overlapping of glow discharges as well as localized application of such voltage to the contact area.

As a result, it is possible to prevent surface roughness due to discharge from occurring on the engine valve, which occurs when an excess voltage is applied to the contact area between the engine valve and the surface-modifying jig. Thus, a stable surface-modifying treatment can be applied to the engine valve, so that a hardened layer having a substantially uniform thickness can be formed on the surface of the engine valve when a nitriding treatment, for example, is applied to the engine valve.

Also, the holder preferably includes a tapered inclined portion, which is inclined in accordance with the shape of the head part of the engine valve. Thus, when the engine valve is set on the surface-modifying jig, the engine valve can be held such that the head part of the engine valve is brought into surface contact with the tapered inclined portion. As a result, since the contact area between the engine valve and the surface-modifying jig can be enlarged, compared to the case where the engine valve is merely in point contact with the surface-modifying jig, when a discharge is generated for applying a surface-modifying treatment to the engine valve, it is possible to prevent overlapping of glow discharges as well as application of excess voltage to the contact area. Thus, a stable surface-modifying treatment can be performed on the engine valve.

Further, the holder preferably includes a ring portion, which is formed in an annular shape in accordance with the shape of the head part of the engine valve. In this case, when the engine valve is set on the surface-modifying jig, the engine valve can be held such that the head part of the engine valve is brought into line contact with the ring portion. As a result, when a discharge is generated for applying a surface-modifying treatment to the engine valve, it is possible to prevent overlapping of glow discharges as well as application of excess voltage to the contact area between the surface-modifying jig and the engine valve. Thus, a stable surface-modifying treatment can be performed on the engine valve.

Furthermore, the holder preferably includes a cylinder portion that surrounds the rod part of the engine valve, in accordance with the shape of the rod part. In this case, when the engine valve is set on the surface-modifying jig, the engine valve can be held such that the rod part of the engine valve is brought into surface contact with the cylinder portion. As a result, when a discharge is generated for applying a surface-modifying treatment to the engine valve, it is possible to prevent overlapping of glow discharges as well as application of excess voltage to the contact area between the surface-modifying jig and the engine valve. Thus, a stable surface-modifying treatment can be performed on the engine valve.

Incidentally, the holder may comprise only one of the tapered portion, the ring portion and the cylinder portion, whereby the engine valve is held in at least one of line contact and surface contact with the holder.

BEST MODE FOR CARRYING OUT THE INVENTION

Preferred embodiments of a surface-modifying method for an engine valve according to the present invention, in relation to a surface-modifying jig used for carrying out the method, shall be described in detail below with reference to the accompanying drawings.

Figure 1:
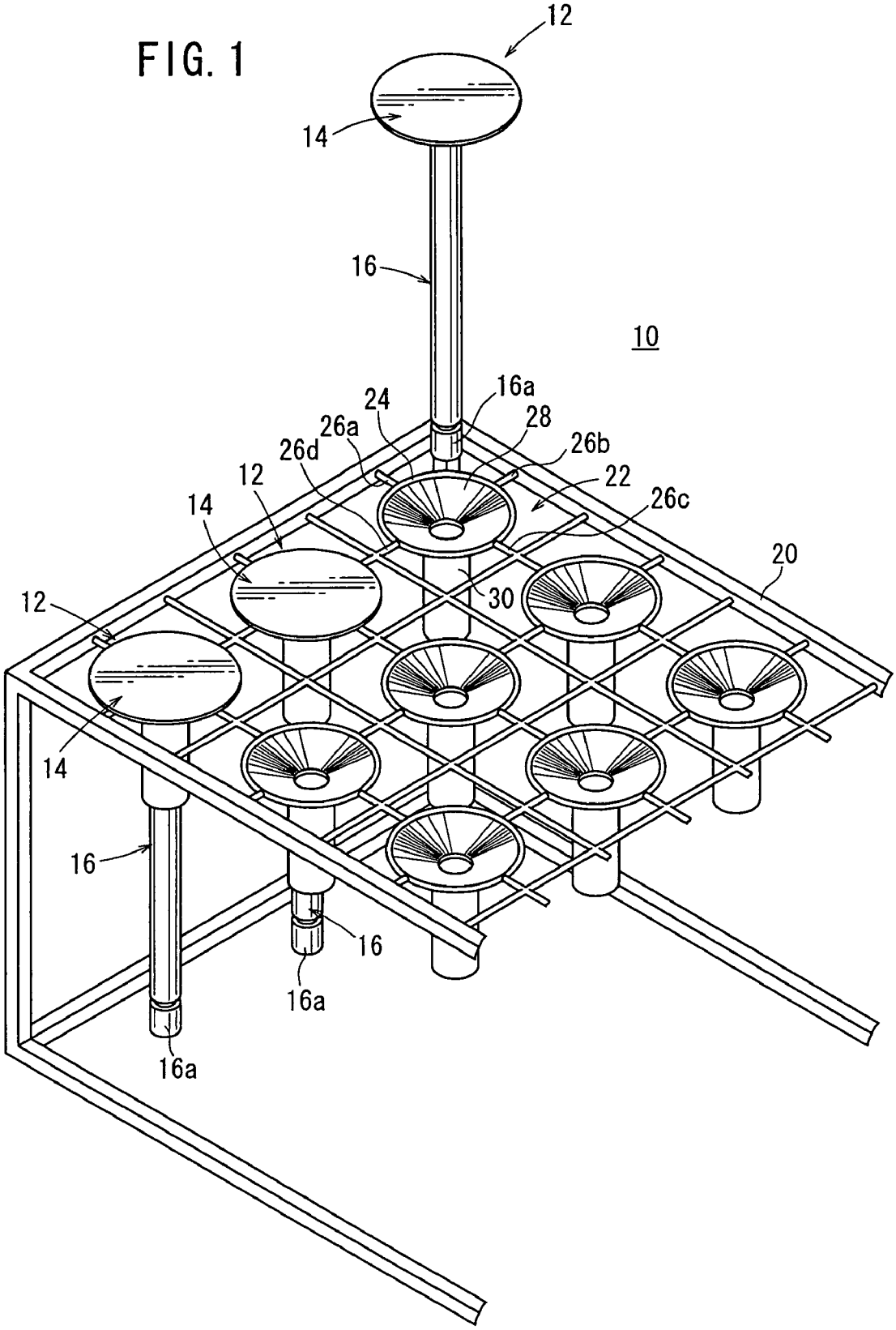
FIG. 1 is a fragmentary perspective view of a surface-modifying jig for engine valves according to an embodiment of the present invention.

In FIG. 1, reference number 10 denotes a surface-modifying jig for an engine valve according to an embodiment of the present invention.

Figure 2:
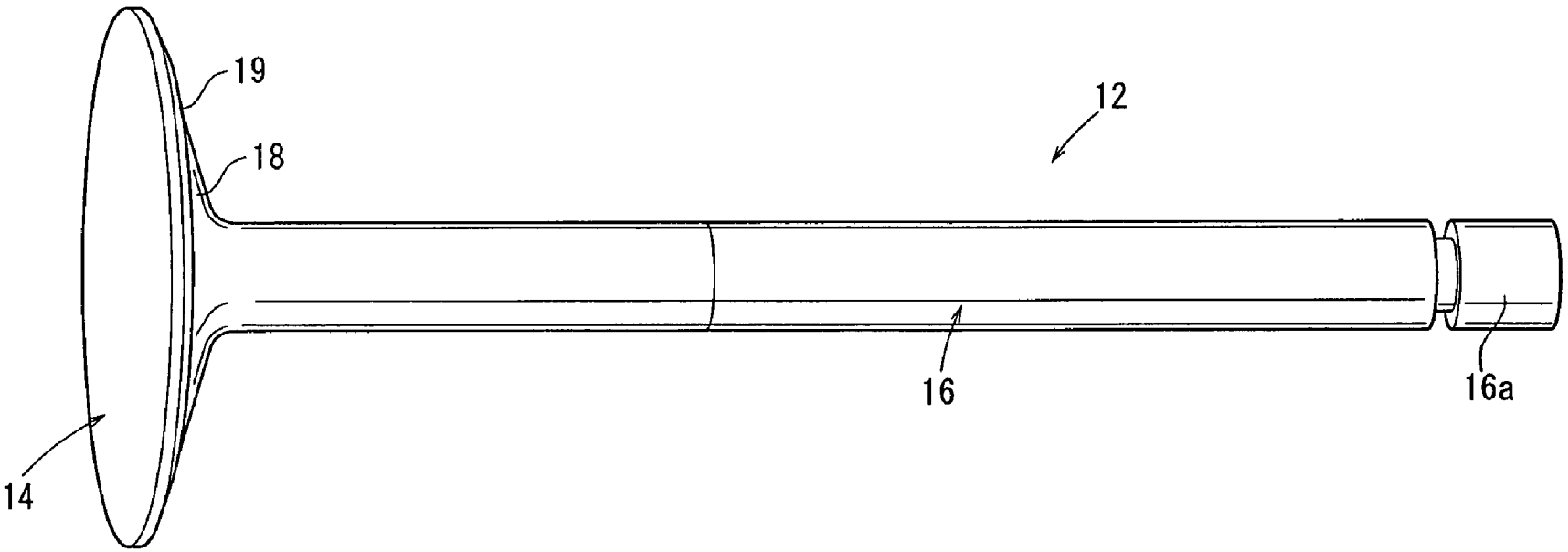
FIG. 2 is a perspective view of an engine valve to be set on the surface-modifying jig shown in FIG. 1.

First, an engine valve 12, to which a nitriding treatment is applied through the surface-modifying jig 10, shall be explained. As shown in FIGS. 1 and 2, the engine valve 12 has a substantially T-shaped cross section, and further comprises a substantially disk-shaped valve head (head part) 14 on one end thereof, and a valve stem (rod part) 16, which extends in a straight line from a substantially center portion of the valve head 14 toward the other end thereof. The valve head 14 seats on and moves away from an intake or discharge port of a cylinder head in an internal combustion engine (not shown).

The valve head 14 is formed in a tapered shape, so that the valve head 14 has a diameter that expands gradually from the joint portion between the valve head 14 and the valve stem 16. Thus, the valve head 14 has a tapered surface 18 on a side thereof that is closer to the valve stem 16 (see FIG. 2). The tapered surface 18 has a seat portion 19 thereon, which is seated on an intake or discharge port of the internal combustion engine. The seat portion 19 is inclined at a predetermined angle, for example, by machining, so that the seat portion 19 has a diameter that becomes reduced gradually and slightly radially inwardly with respect to the tapered surface 18.

The valve stem 16 is formed into a thin rod shape having a substantially uniform diameter, and extends a predetermined length in the direction away from the valve head 14.

The surface-modifying jig 10, on which the above engine valve 12 is set, is formed from a metal frame 20 having a substantially rectangular parallelepiped shape. The jig 10 has a plurality of substantially rectangular blocks 22 formed on the upper part thereof, as shown in FIG. 1. The blocks 22 are formed in a grid pattern from a rod shaped material having a substantially circular cross section. Further, the blocks 22 are shaped substantially the same as each other, and are arranged in rows on the upper part of the surface-modifying jig 10. In addition, the surface-modifying jig 10 is connected to a power source (not shown) and serves as an electrode (cathode), which is supplied with an electric current by the power source.

Figure 3:
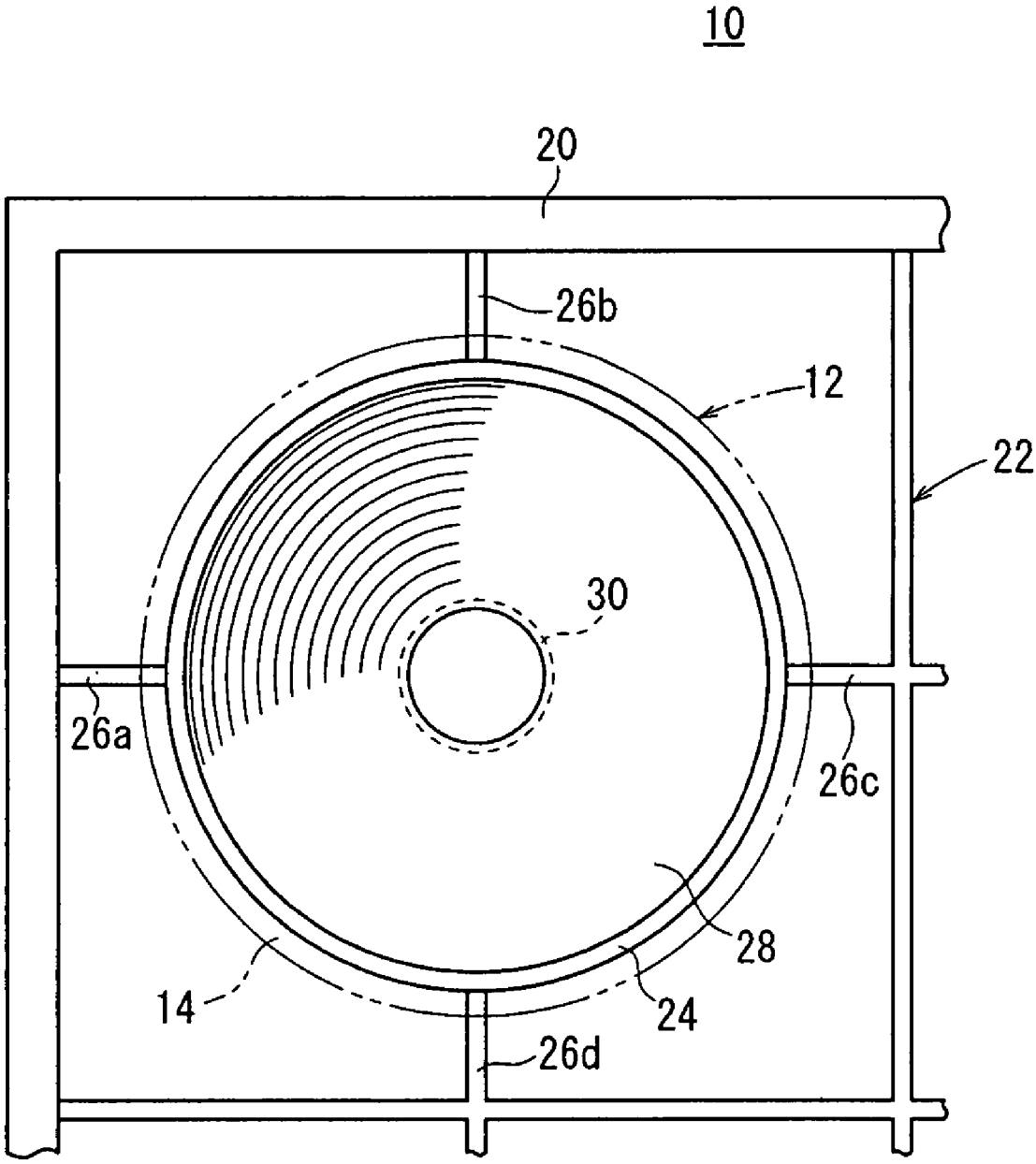
FIG. 3 is an enlarged plan view showing a vicinity of a block in the surface-modifying jig of FIG. 1.

As shown in FIGS. 1 and 3, each of the blocks 22 consists of four sides of substantially equal length, comprising a circular ring portion 24 formed in a substantially central area thereof. The ring portion 24 is connected to the block 22 or the frame 20 via four connection parts 26*a* to 26*d*, each of which projects from an outer circumference of the ring portion 24, substantially perpendicular to one of the four sides of the block 22 or the frame 20. That is, the ring portion 24 is supported by the four connection parts 26*a* to 26*d* at a substantially central area of the block 22. As with the block 22, the ring portion 24 and the connection parts 26*a* to 26*d* are formed respectively from a rod shaped material having a substantially circular cross section.

A head holder (inclined portion) 28 is formed on the inner circumference of the ring portion 24, integrally with the ring portion 24. The head holder 28 protrudes downwardly from the ring portion 24 and has a diameter that becomes reduced gradually radially inwardly toward the lower part of the surface-modifying jig 10. A stem holder (cylinder portion) 30, having a substantially constant diameter, is formed on the lower portion of the head holder 28. The stem holder 30 extends a predetermined length in a direction away from the head holder 28. The head holder 28 and the stem holder 30 are formed respectively, for example, from a sheet plate material having a substantially uniform thickness.

Figure 4:
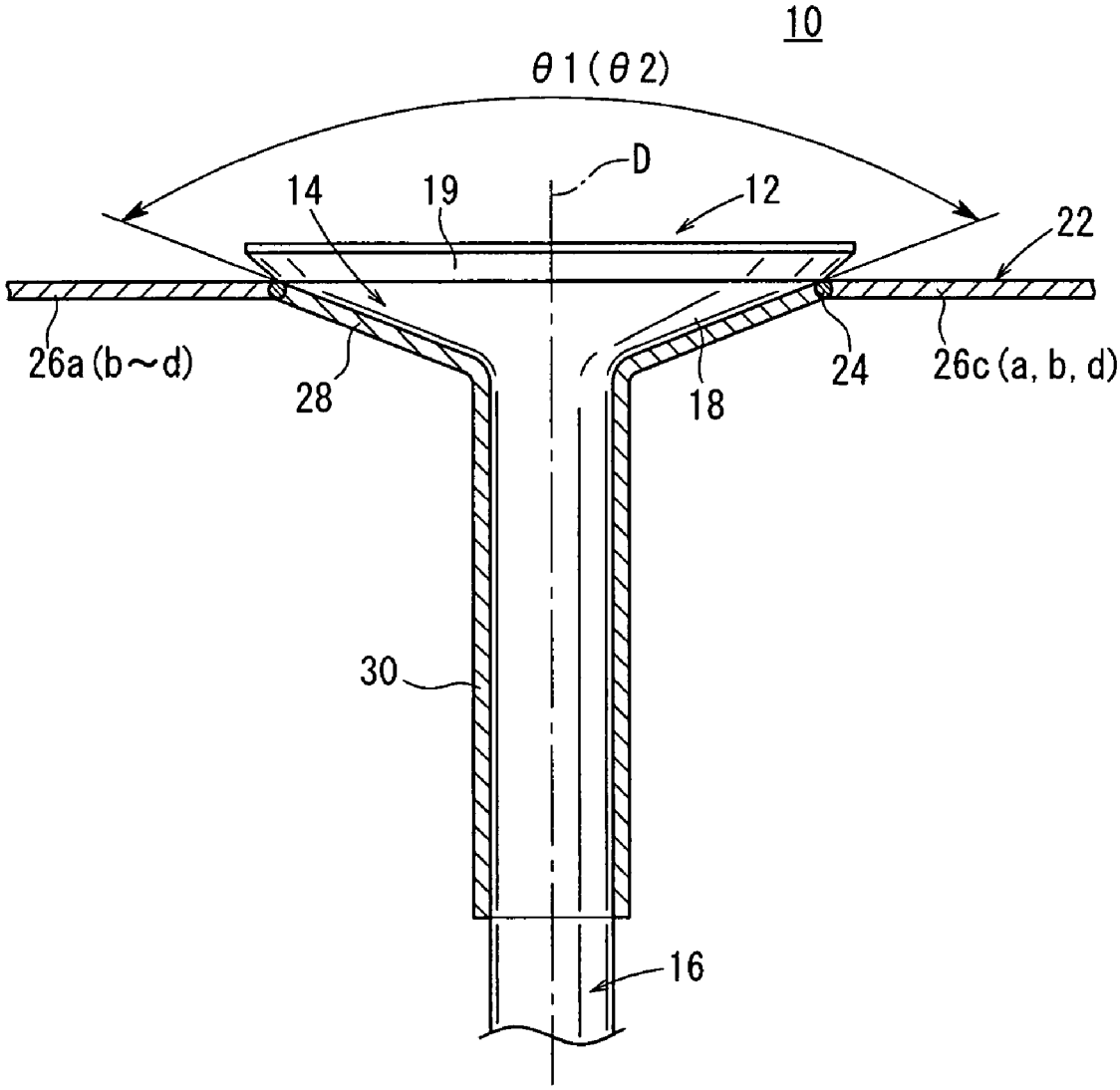
FIG. 4 is an enlarged vertical sectional view of a vicinity of a block, showing a state in which an engine valve is set on the surface-modifying jig of FIG. 1.

As shown in FIG. 4, the head holder 28 opens upwardly at a predetermined angle of inclination $\theta 1$ (ex., 120°), with a center thereof lying on the center line D of the ring portion 24. The head holder 28 has a smooth inner wall surface, which contacts the tapered surface 18 of the valve head 14 in the engine valve 12. That is, the angle of inclination $\theta 1$ of the head holder 28 is substantially equal to the inclined angle $\theta 2$ of the tapered surface 18 of the valve head 14 ($\theta 1 \approx \theta 2$).

Also, the internal diameter of the stem holder 30 is substantially equal to the external diameter of the valve stem 16 in the engine valve 12.

When the engine valve 12 is set on the surface-modifying jig 10, the valve stem 16 is inserted into the stem holder 30, whereupon the outer surface of the valve stem 16 is held in contact with the inner surface of the stem holder 30, while the valve head 14 of the engine valve 12 is held in contact with the head holder 28. That is, the valve head 14 is brought into annular surface contact with the head holder 28 having a smooth surface, and further is brought into annular line contact with the ring portion 24 having a substantially circular cross section. Also, the valve stem 16 is brought into annular surface contact with the stem holder 30 that has a substantially uniform diameter.

Thus, the engine valve 12 can reliably and stably be held in the surface-modifying jig 10 by the ring portion 24, the head holder 28 and the stem holder 30.

Figure 5:
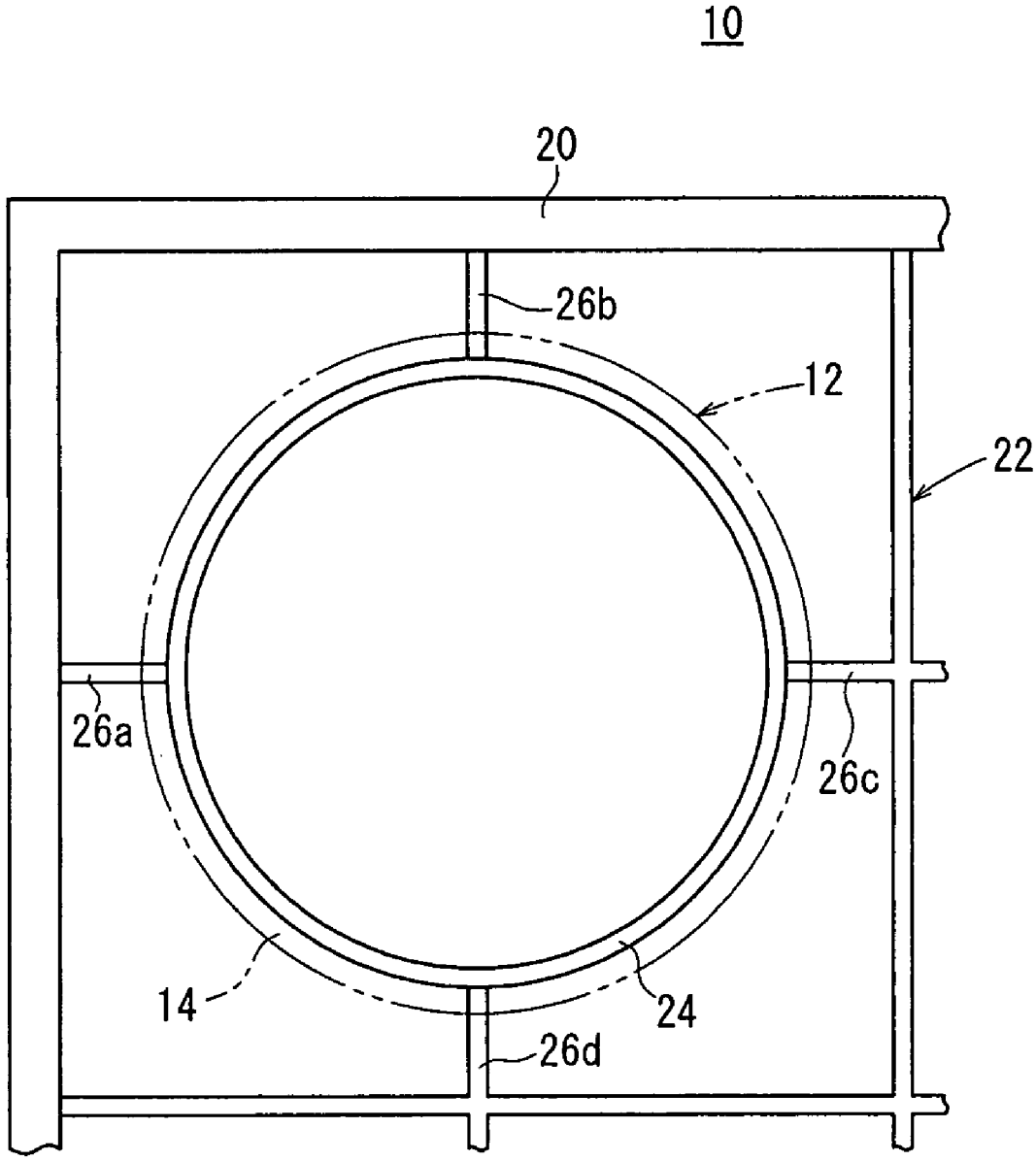
FIG. 5 is an enlarged plan view of a modified embodiment of a surface-modifying jig, in which an engine valve is held only by a ring portion, in contrast to the features shown in FIG. 3.

Also, as shown in FIG. 5, the valve head 14 of the engine valve 12 may be held in the above surface-modifying jig 10 by the ring portion 24 only, without the head holder 28. In this arrangement, the surface of the valve head 14 is brought into annular line contact with the ring portion 24 along the circumference of the ring portion 24.

Figure 6:
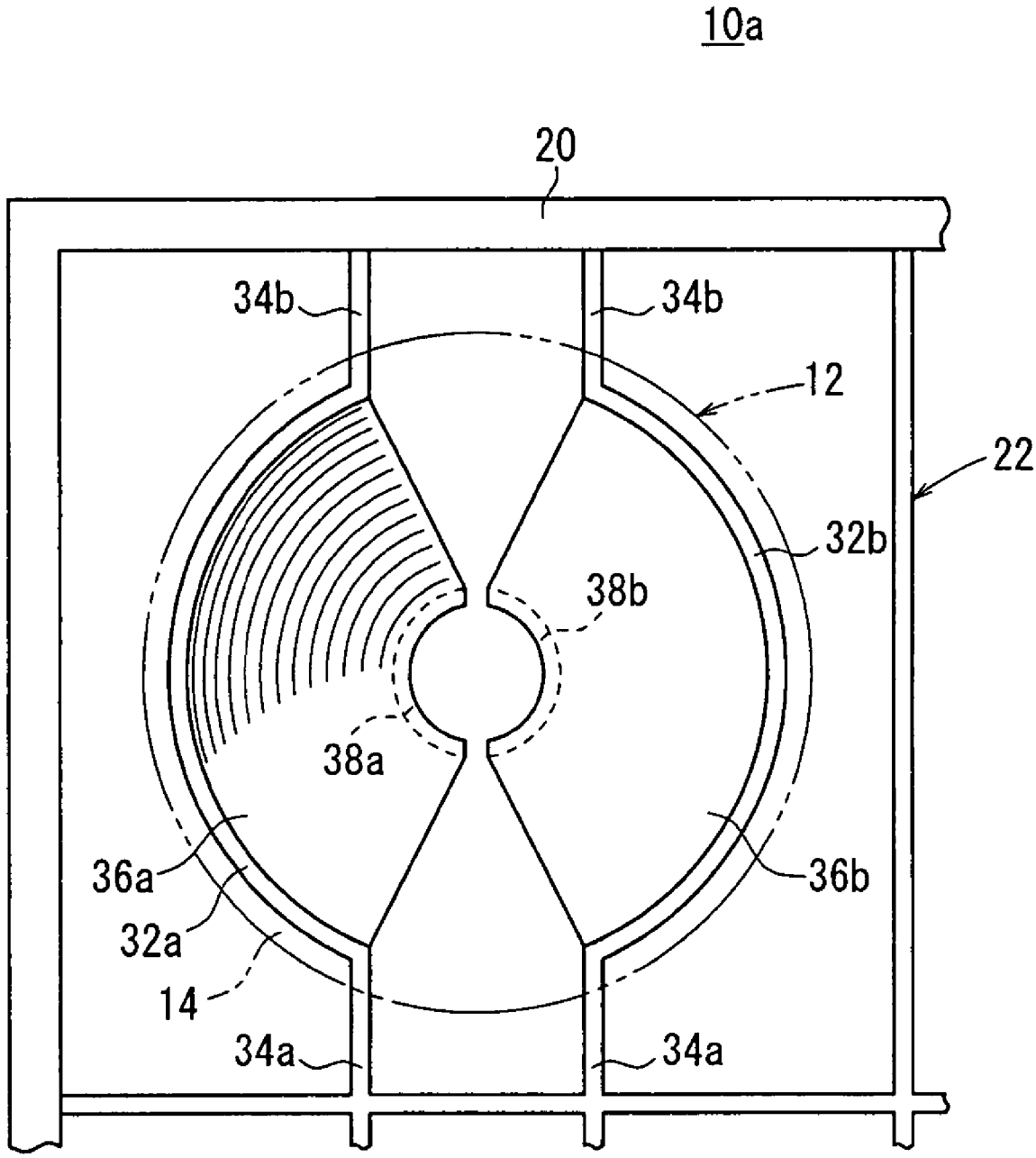
FIG. 6 is an enlarged plan view of a modified embodiment of a surface-modifying jig, which is provided with a pair of circular arc sections in place of the ring portion, formed in the block of FIG. 3.

However, the surface-modifying jig 10 is not limited to an arrangement in which the block 22 of the jig 10 has a ring portion 24 formed in a substantially central area thereof. As shown in FIG. 6, the surface-modifying jig 10 may be formed in an arrangement such that the block 22 includes a set of opposite arc portions 32*a*, 32*b*, which are spaced a given interval away from a substantially central area of the block 22, wherein each of the arc portions 32*a*, 32*b* has a substantially semicircular shape. With this arrangement, both opposite ends of the arc portions 32*a*, 32*b* are connected to the block 22 via connection portions 34*a* and 34*b*, which extend toward two opposite sides of the block 22, respectively. Incidentally, the arc portions 32*a*, 32*b* and connection portions 34*a*, 34*b* have a substantially circular cross section, respectively.

In this case, the arc portions 32*a*, 32*b* have a pair of head holders (inclined portions) 36*a*, 36*b* formed on inner circumferences thereof for holding the valve head 14. Each of the head holders 36*a*, 36*b* has a diameter that gradually becomes reduced radially inwardly in a downward direction. Also, a pair of stem holders (cylinder portions) 38*a*, 38*b* for holding the valve stem 16 are formed on lower portions of the head holders 36*a*, 36*b*, respectively. Each of the stem holders 38*a*, 38*b* has a semicircular cross section. That is, the pair of the arc portions 32*a*, 32*b*, the head holders 36*a*, 36*b* and the stem holders 38*a*, 38*b* are all adapted so as to be symmetrical with respect to the center of the block 22.

With this arrangement, the valve head 14 can suitably be held between the pair of arc portions 32*a*, 32*b* and between the pair of head holders 36*a*, 36*b*. Also, the valve stem 16 can suitably be held between the pair of stem holders 38*a*, 38*b*. Thus, the engine valve 12 can reliably and stably be held by the surface-modifying jig 10*a*. In this case, the valve head 14 can be brought into annular surface contact with the pair of head holders 36*a*, 36*b* having a smooth surface, forming an annular line of contact with the pair of arc portions 32*a*, 32*b* having a substantially circular cross-section. Further, the valve stem 16 can be brought into annular surface contact with the pair of stem holders 38*a*, 38*b*.

Figure 7:
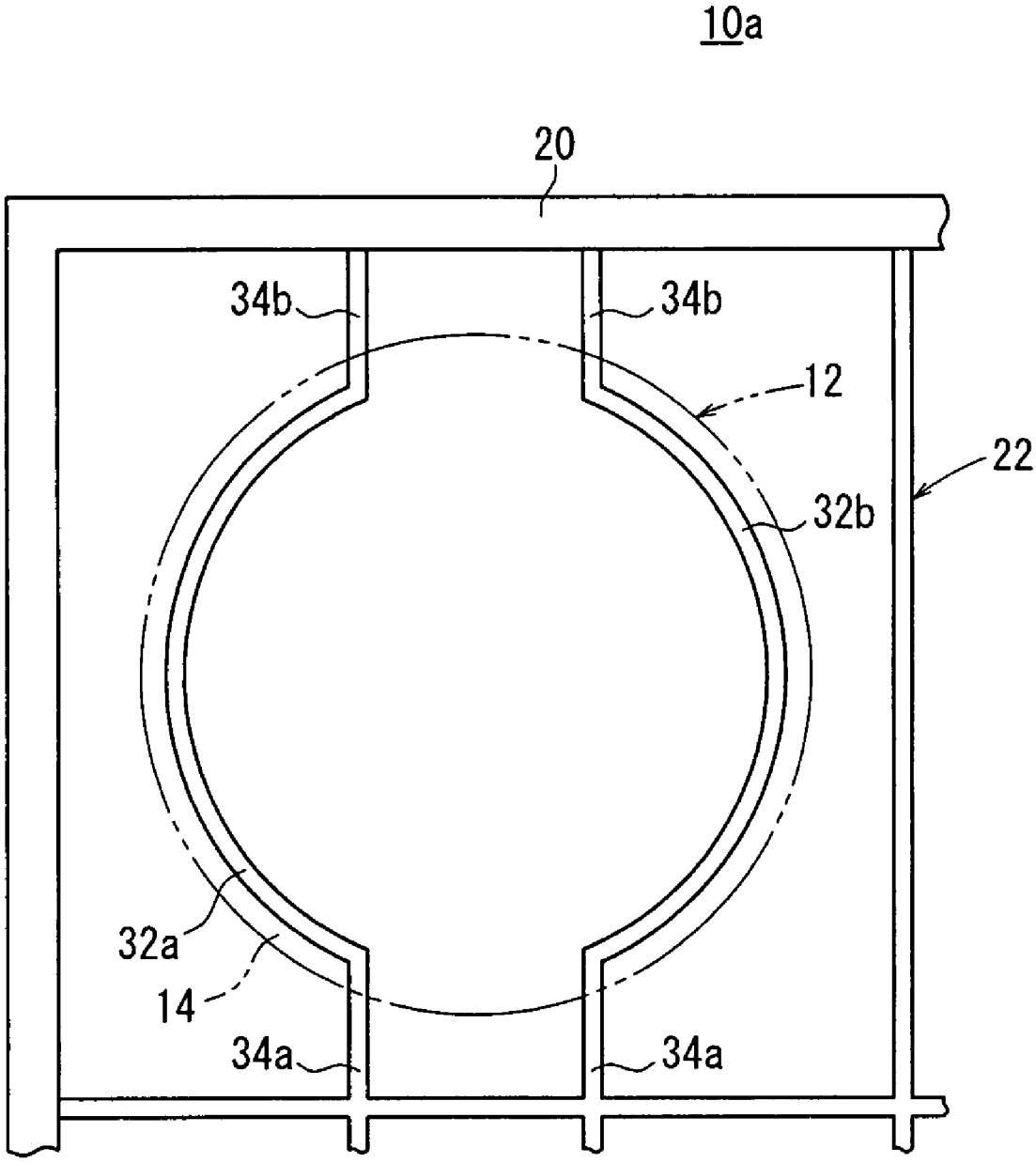
FIG. 7 is an enlarged plan view of a modified embodiment of a surface-modifying jig, in which an engine valve is held only by a pair of arc portions, in contrast to the features shown in FIG. 6.

Also, as shown in FIG. 7, the valve head 14 of the engine valve 12 may be held in the above surface-modifying jig 10*a* only by the pair of arc portions 32*a*, 32*b*, without the head holders 36*a*, 36*b*. With this arrangement, the surface of the valve head 14 is held in line contact with circumferences of the circular arc portions 32*a*, 32*b* over a predetermined length.

The surface-modifying jig 10 according to the embodiment of the present invention is basically constructed as described above. Next, a nitriding treatment to be applied to the engine valve 12 shall be described below.

Figure 8:
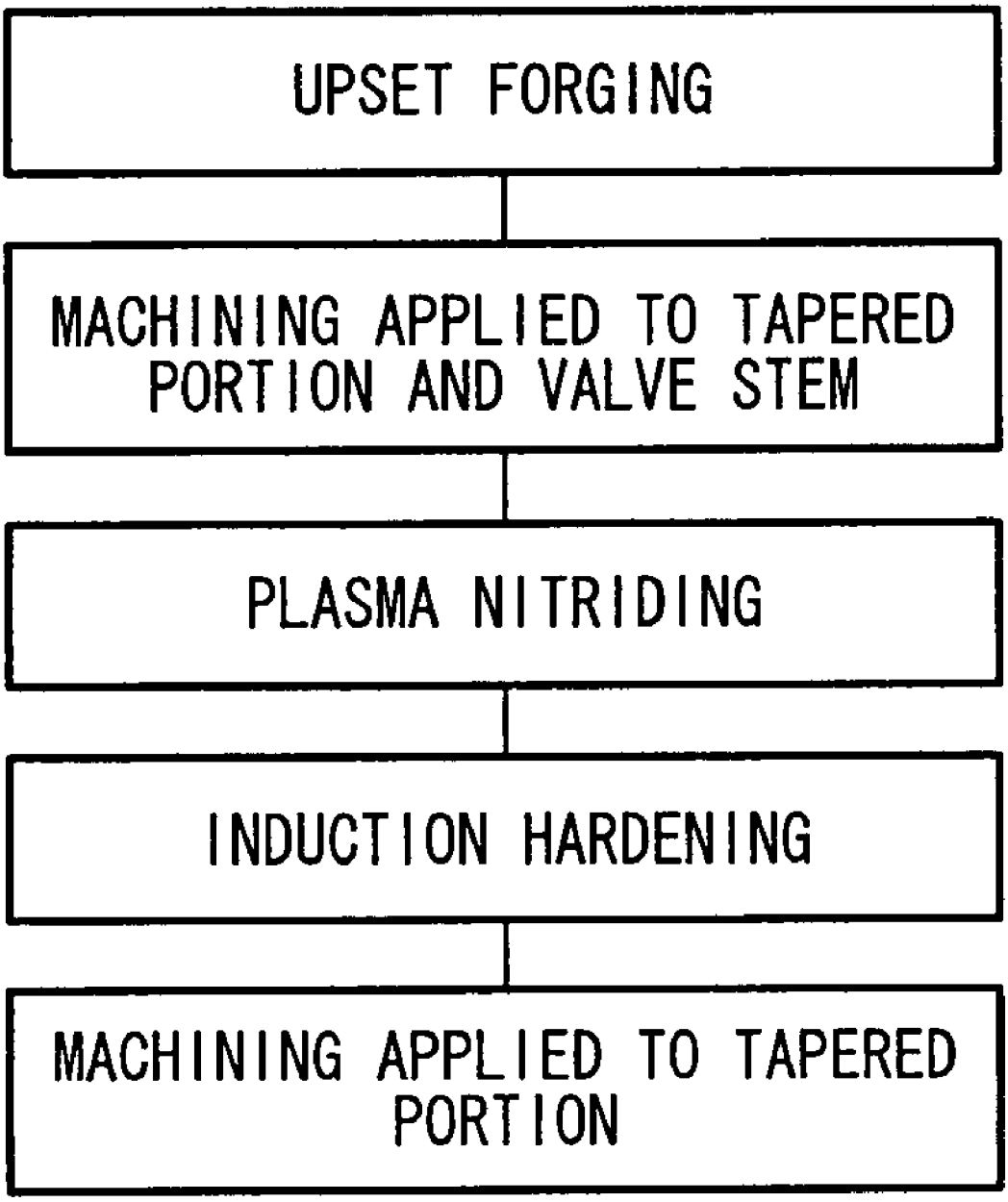
FIG. 8 is a flowchart showing a production process and surface-modifying treatment process for an engine valve.

First, as shown in FIG. 8, the engine valve 12, consisting of the valve head 14 and the valve stem 16, is formed by forging (upset forging) from, for example, a rod material, made up of an iron group series alloy, to thereby expand the diameter of the rod material at the head. During forging, a passivation film (oxide film) spontaneously is generated on the surface of the engine valve 12, due to heat energy applied during forging and the processing heat energy resulting from deforming.

Next, the seat portion 19 is formed on a side of the valve head 14 that is closer to the valve stem 16, by machining (e.g., cutting) a contact portion of the valve head 14, which contacts the intake and discharge ports (not shown) of the cylinder head, and an outer circumferential surface of the valve stem 16 held by the cylinder head. As a result of such machining, the passivation film generated on the outer circumferential surfaces of the seat portion 19 and the valve stem 16 is partially removed.

Then, a plasma nitriding (ion nitriding) treatment is applied to the engine valve 12. First, nitride gas is introduced into a treatment furnace where the surface-modifying jig 10 is located, and a voltage is applied in the presence of the nitride gas between the treatment furnace, which acts as an anode, and the engine valve 12, which acts as a cathode. Then, a glow discharge is generated between the treatment furnace and the engine valve 12, so as to ionize the nitride gas into a plasma state, and thereby heat the engine valve 12 while the nitriding treatment is applied to the surface of the engine valve 12. Thus, a hardened layer having a predetermined thickness is formed on the surface of the engine valve 12.

In this case, the engine valve 12, which serves as a cathode for the formation of a glow discharge, is held in line and surface contact with the metal surface-modifying jig 10. That is, since the engine valve 12 is held by the head holder 28, the stem holder 30 and the ring portion 24 of the surface-modifying jig 10, with a larger area of contact between the engine valve 12 and the surface-modifying jig 10, voltage that is applied to the area of contact between the engine valve 12 and the surface-modifying jig 10 can be widely dispersed during the discharge. Thus, excess voltage is not applied locally to the area of contact. Also, overlapping glow discharges do not occur on the engine valve 12 and the surface-modifying jig 10, respectively.

Therefore, it is possible to prevent discharged surface roughness or the like from occurring due to overlapping glow discharges and excess voltage on the area of contact between the engine valve 12 and the surface-modifying jig 10. Accordingly, irregularities on the surface of the engine valve 12, due to discharged surface roughness, can be prevented.

As mentioned above, when the nitriding treatment is applied to the engine valve 12, the surface-modifying jig 10 holds the engine valve 12 in surface contact and line contact with the valve head 14 and the valve stem 16 of the engine valve 12. Thus, when a discharge is generated for conducting a plasma nitriding treatment using the above-mentioned surface-modifying jig 10, discharged surface roughness, which occurs due to overlapping of glow discharges and application of excess voltage to the area of contact between the engine valve 12 and the surface-modifying jig 10, can reliably be prevented. Therefore, a stable nitriding treatment can be applied to the engine valve 12, so as to form a hardened layer of substantially uniform thickness on the surface of the engine valve 12, thereby improving abrasion resistance.

Also, in the engine valve 12 that is subjected to the nitriding treatment by plasma nitriding, it is necessary to form a hardened layer only on the valve stem 16 portion thereof, which slidingly moves with respect to the cylinder head (not shown). Accordingly, as shown in FIG. 8, induction hardening is applied to the seat portion 19 of the valve head 14, and to one end 16*a* of the valve stem 16, in order to improve the strength of the seat portion 19 and the end 16*a* of the valve stem 16, respectively.

Then, after induction hardening has been applied to the valve head 14 and the valve stem 16, in order to improve dimensional accuracy, machining is applied again only to the seat portion 19 that contacts the intake or discharge port of the cylinder head (see FIG. 8).

Thus, the engine valve 12 (see FIG. 2) as a final product is obtained.

In addition, in order to remove a passivation film remaining on the engine valve 12, hydrogen sputtering may be performed, either prior to or concurrently with the plasma nitriding treatment.

A case where hydrogen sputtering is applied to the engine valve 12 shall be explained below. More specifically, a case in which hydrogen sputtering is applied prior to a plasma nitriding treatment shall be explained.

First, a machined engine valve 12 is set on a block 22 of the surface-modifying jig 10, with the valve head 14 facing upward and the valve stem 16 downward, as shown in FIGS. 1 and 4. With this arrangement, the valve stem 16 is inserted through the ring portion 24 into the stem holder 30, whereby the outer circumferential surface of the valve stem 16 is supported by an inner circumferential surface of the stem holder 30. Also, the tapered surface 18 of the valve head 14 is held by an inner circumferential surface of the ring portion 24 and the inner wall surface of the head holder 28.

Specifically, the valve head 14 is brought into annular surface contact with the head holder 28 having a smooth surface, and into annular line contact with the substantially annular ring portion 24. Also, the valve stem 16 is brought into annular surface contact with the stem holder 30 that has a substantially uniform diameter. Incidentally, since the surface-modifying jig 10 is provided with a plurality of blocks 22, a plurality of engine valves 12 can be set into the surface-modifying jig 10 at a time.

The engine valve 12 thus is held by the block 22 of the surface-modifying jig 10. Then, the surface-modifying jig 10 is located inside the treatment furnace (not shown), after which the treatment furnace is evacuated and hydrogen gas is introduced into the treatment furnace. In the presence of hydrogen gas, a high voltage is applied between the treatment furnace, which acts as an anode, and the engine valve 12, which acts as a cathode, so as to ionize the hydrogen gas by glow discharge. Thus, ionized hydrogen gas collides against the surface of the engine valve 12 at high velocities. As a result, a passivation film on the engine valve 12 is hydrogen-reduced and removed. In this case as well, discharged surface roughness or the like can be prevented, which occurs due to overlapping of glow discharges and application of excess voltage to the contact area between the engine valve 12 and the surface-modifying jig 10.

As mentioned above, the surface-modifying jig 10 according to the embodiment of the present invention can suitably be used also as a jig for performing hydrogen-sputtering. In this case, when a plasma nitriding treatment is applied to the engine valve 12, from which a passivation film has been removed by such hydrogen sputtering, it is possible to form a more stable hardened layer of a uniform depth on the surface of the engine valve 12.

Figure 9:
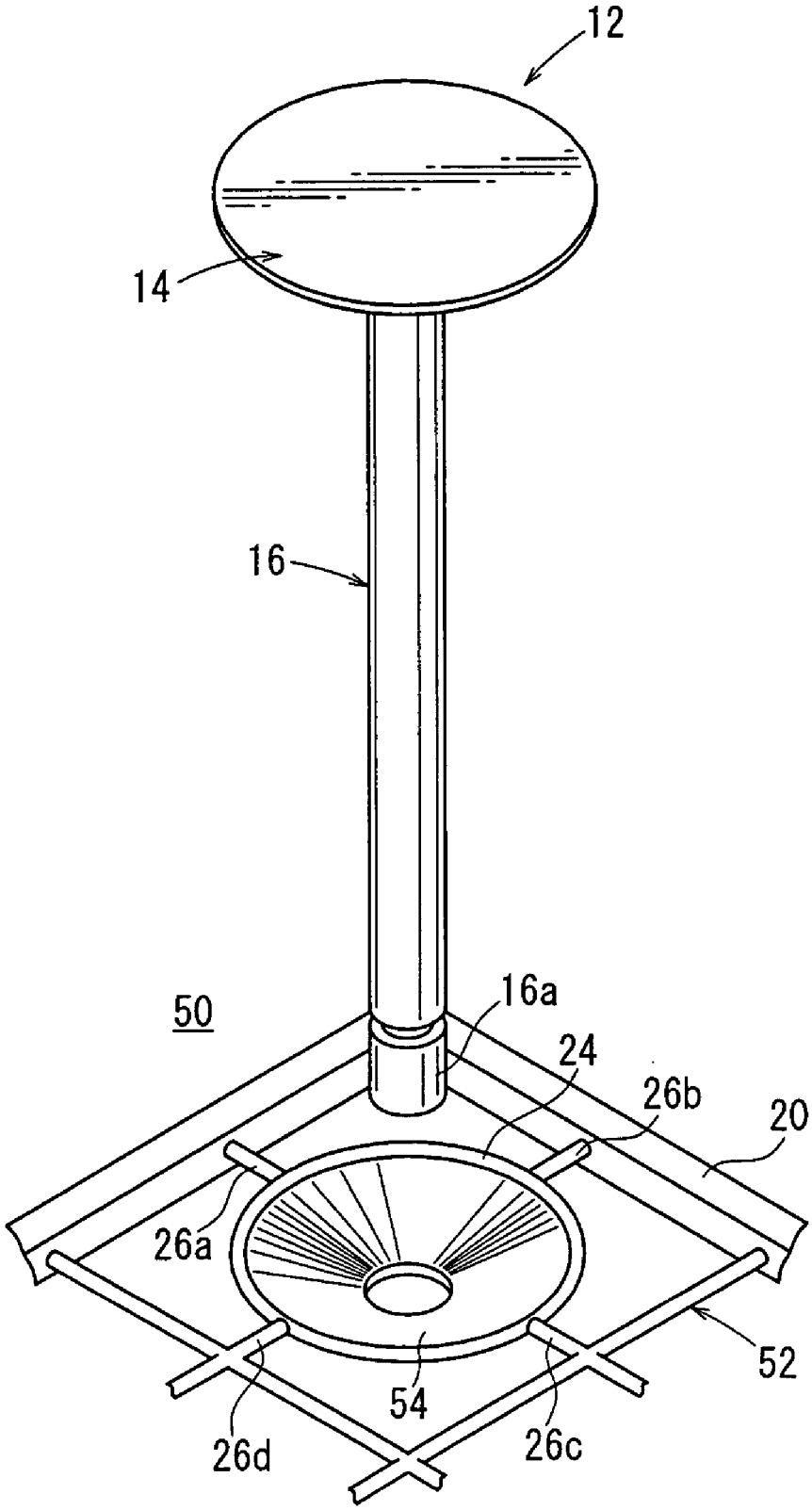
FIG. 9 is a fragmentary perspective view of a modified embodiment of a surface-modifying jig, having a block in which only a head holder is formed therein for holding a valve head of an engine valve.
Figure 10:
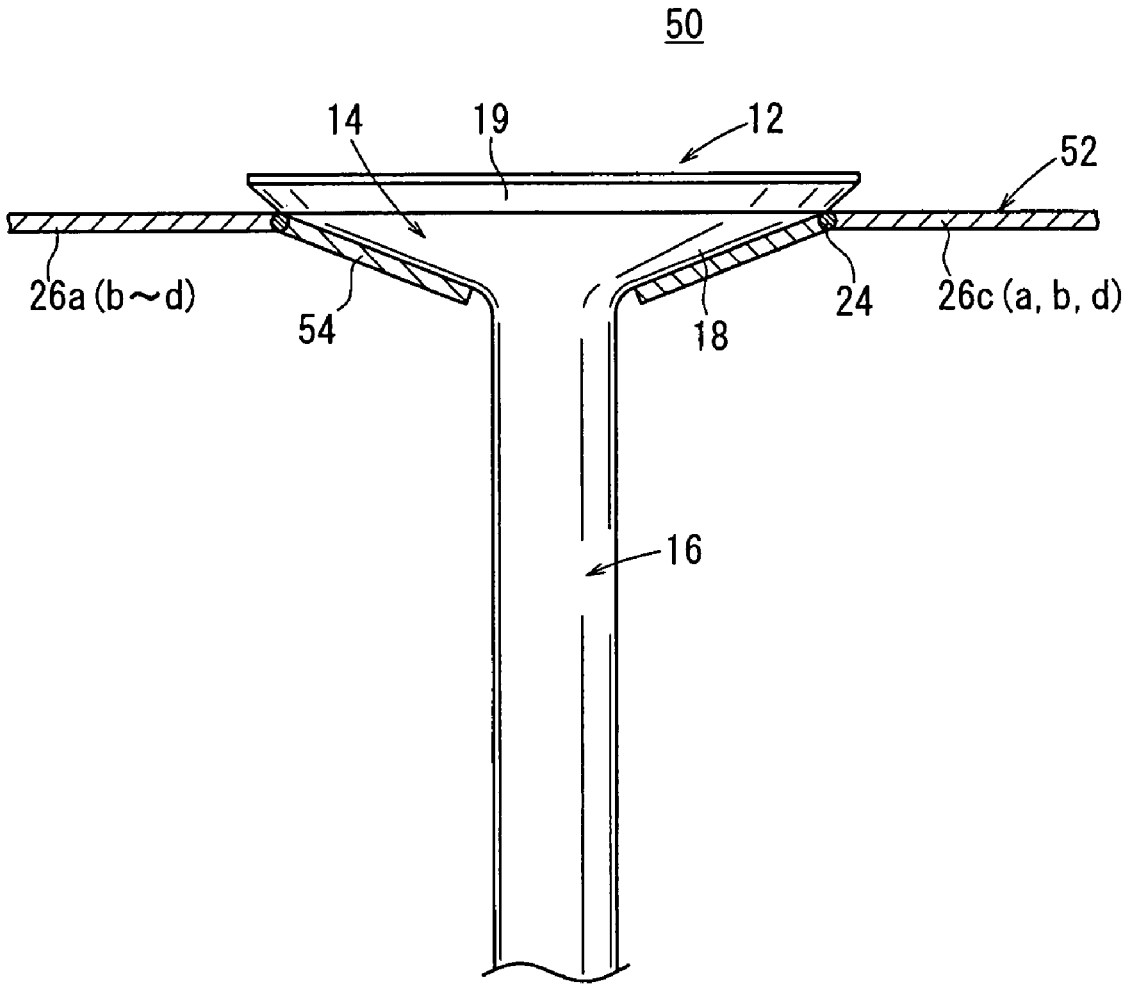
FIG. 10 is an enlarged vertical sectional view showing the vicinity of a block of the surface-modifying jig shown in FIG. 9.
Figure 11:
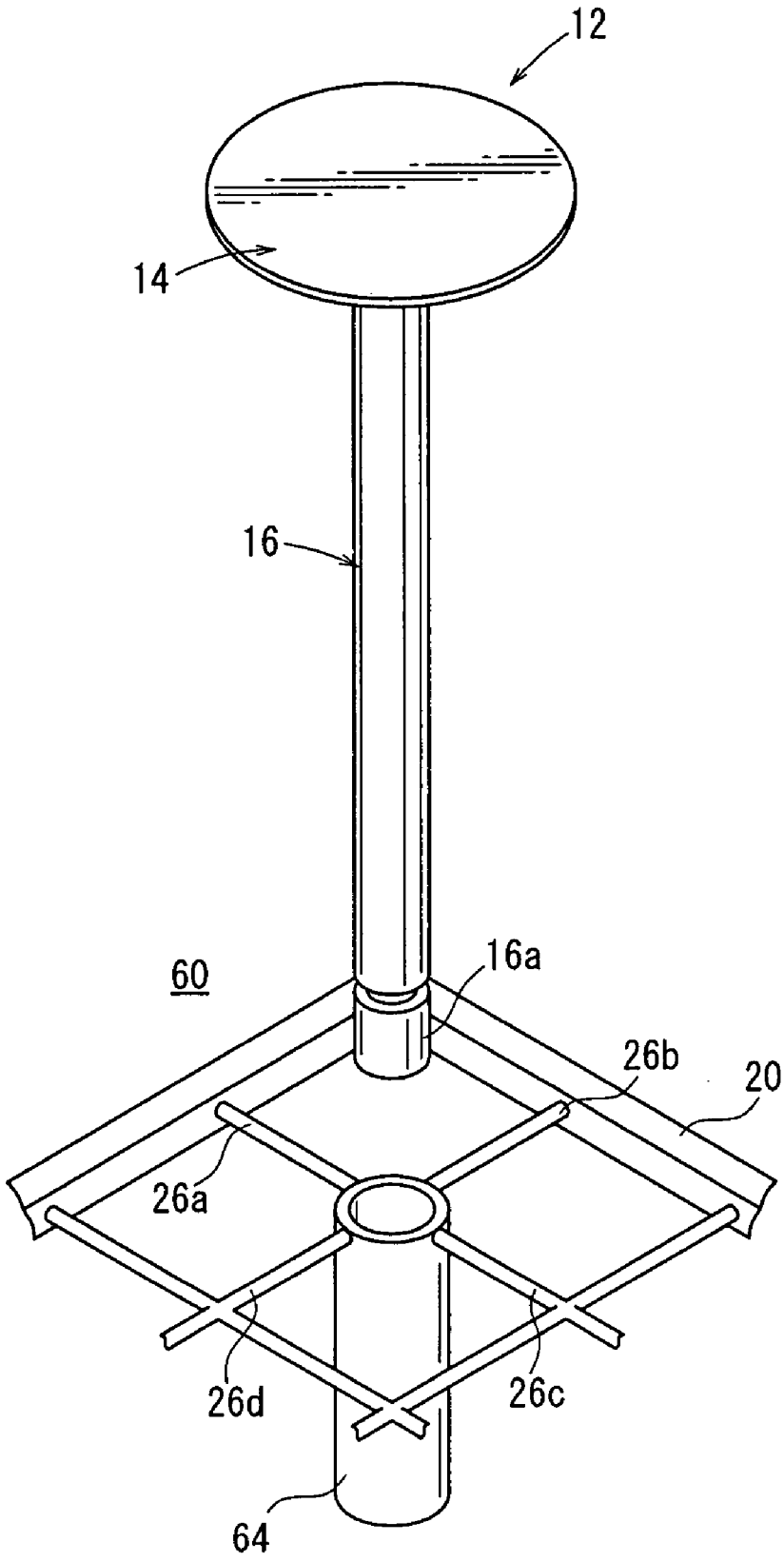
FIG. 11 is a fragmentary perspective view of a modified embodiment of a surface-modifying jig, having a block in which only a stem holder is formed therein for holding a valve stem of an engine valve.
Figure 12:
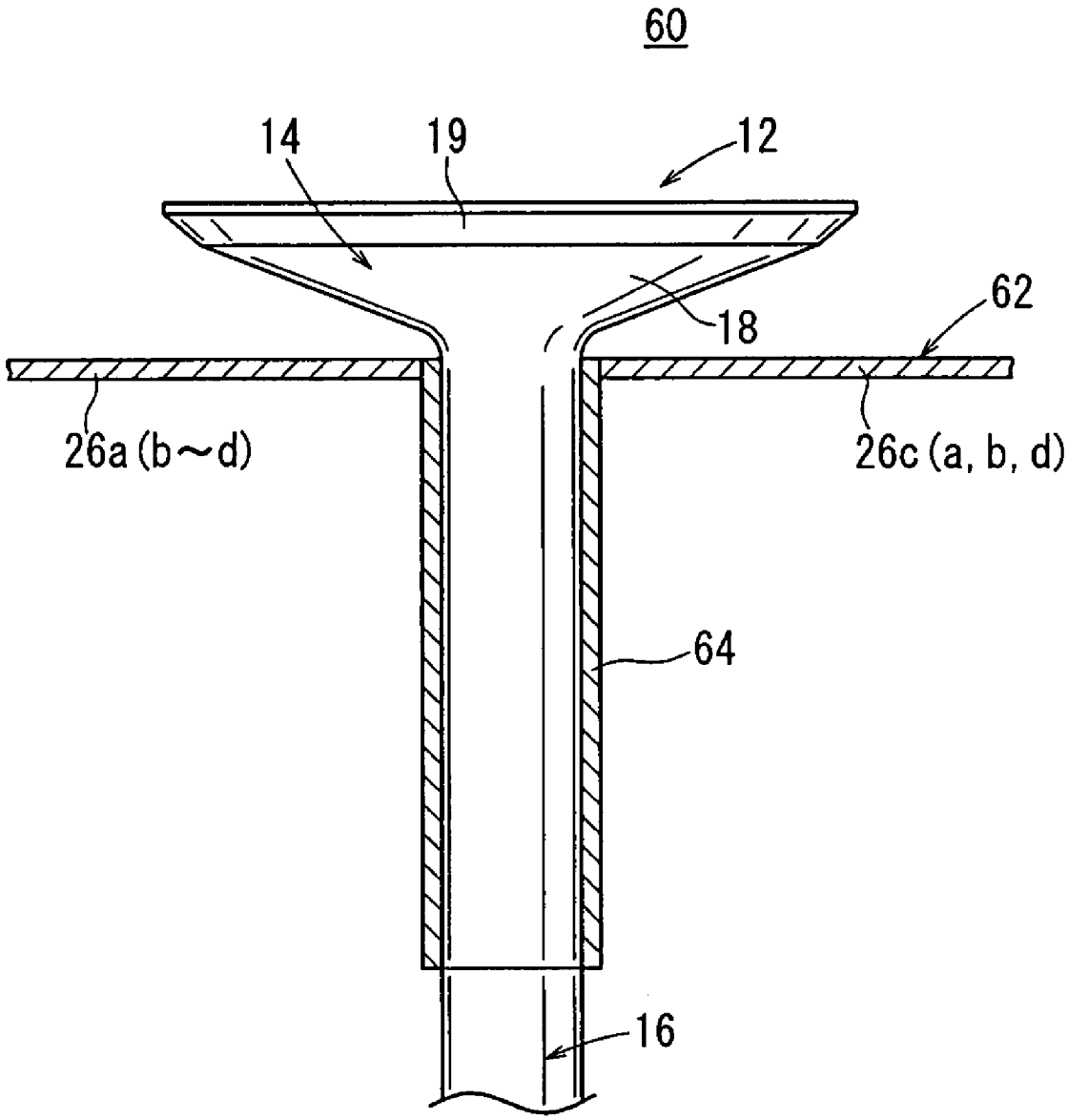
FIG. 12 is an enlarged vertical sectional view showing the vicinity of a block of the surface-modifying jig shown in FIG. 11.

In the above embodiment, the surface-modifying jig 10, which is provided with the head holder 28 and the stem holder 30 for holding the valve head 14 and valve stem 16 of the engine valve 12, has been explained. However, the invention is not limited to the above embodiment. As shown in FIGS. 9 and 10, the surface-modifying jig 50, in the block 52 thereof, may have only a head holder (inclined portion) 54 for holding the valve head 14. Further, as shown in FIGS. 11 and 12, the surface-modifying jig 60, in the block 62 thereof, may have only a stem holder (cylinder portion) 64 for holding the valve stem 16 of the engine valve 12.

In the surface-modifying jig 50 shown in FIGS. 9 and 10, the engine valve 12 can suitably be held such that the ring portion 24 is brought into annular line contact with the valve head 14, and the head holder 54 is brought into annular surface contact with the valve head 14. Meanwhile, in the surface-modifying jig 60 shown in FIGS. 11 and 12, the valve stem 16 can be brought into surface contact with the surface-modifying jig 60 through the stem holder 64. Thus, it is possible to prevent overlapping of glow discharges as well as application of excess voltage to the area of contact between the valve head 14 and the surface-modifying jigs 50, 60, and hence reliably prevent discharged surface roughness from occurring on the engine valve 12. That is, in any case, the plasma nitriding treatment can stably be applied to the engine valve 12, and thus it is possible to form a hardened layer having a substantially uniform depth on the surface of the engine valve 12, thereby improving abrasion resistance.

Incidentally, in the above embodiment, hydrogen-sputtering and plasma nitriding treatments have been explained by way of example. However, the surface treatment for the engine valve 12 is not limited to the above-mentioned treatments. The surface treatment may be any treatment in which a plasma can be generated by discharge, so as to surface-modify the engine valve 12 in the presence of the plasma.

Figure 13:
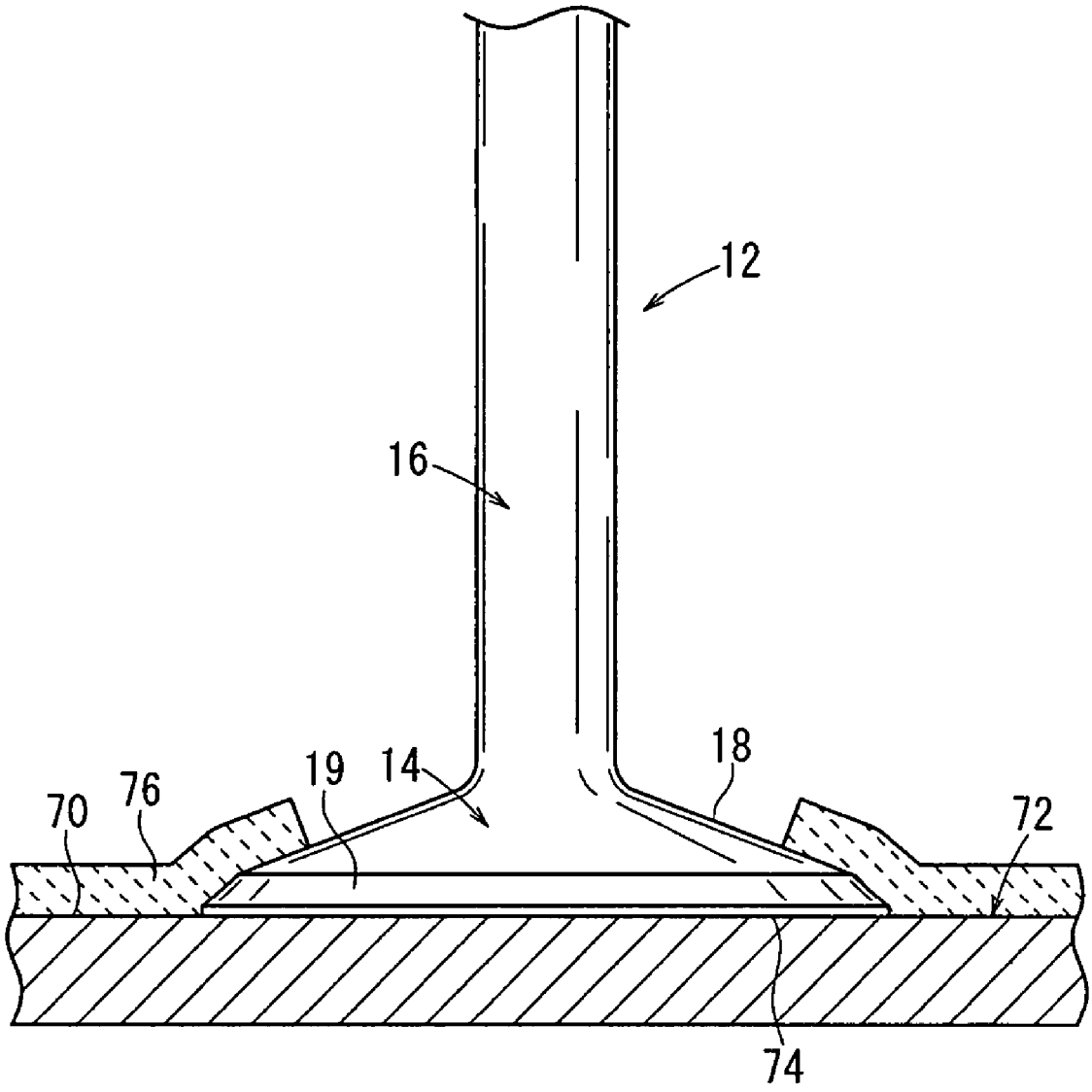
FIG. 13 is an enlarged vertical sectional view of a surface-modifying jig, which has a planar portion for holding a valve head of an engine valve.

As shown in FIG. 13, a surface-modifying jig 72, which has a planar portion 70 for holding the valve head 14 of the engine valve 12, may also be employed. In the surface-modifying jig 72, the planar portion 70 is brought into contact with a plane 74 of the engine valve 12, which is opposite to the tapered surface 18, whereupon the engine valve 12 is fixed by partially covering the valve head 14 from the top thereof with a holding member 76 made from, for example, a ceramic material or the like. Thus, the valve head 14 can be prevented from being displaced, and can reliably be positioned in relation to the surface-modifying jig 72.

Figure 14:
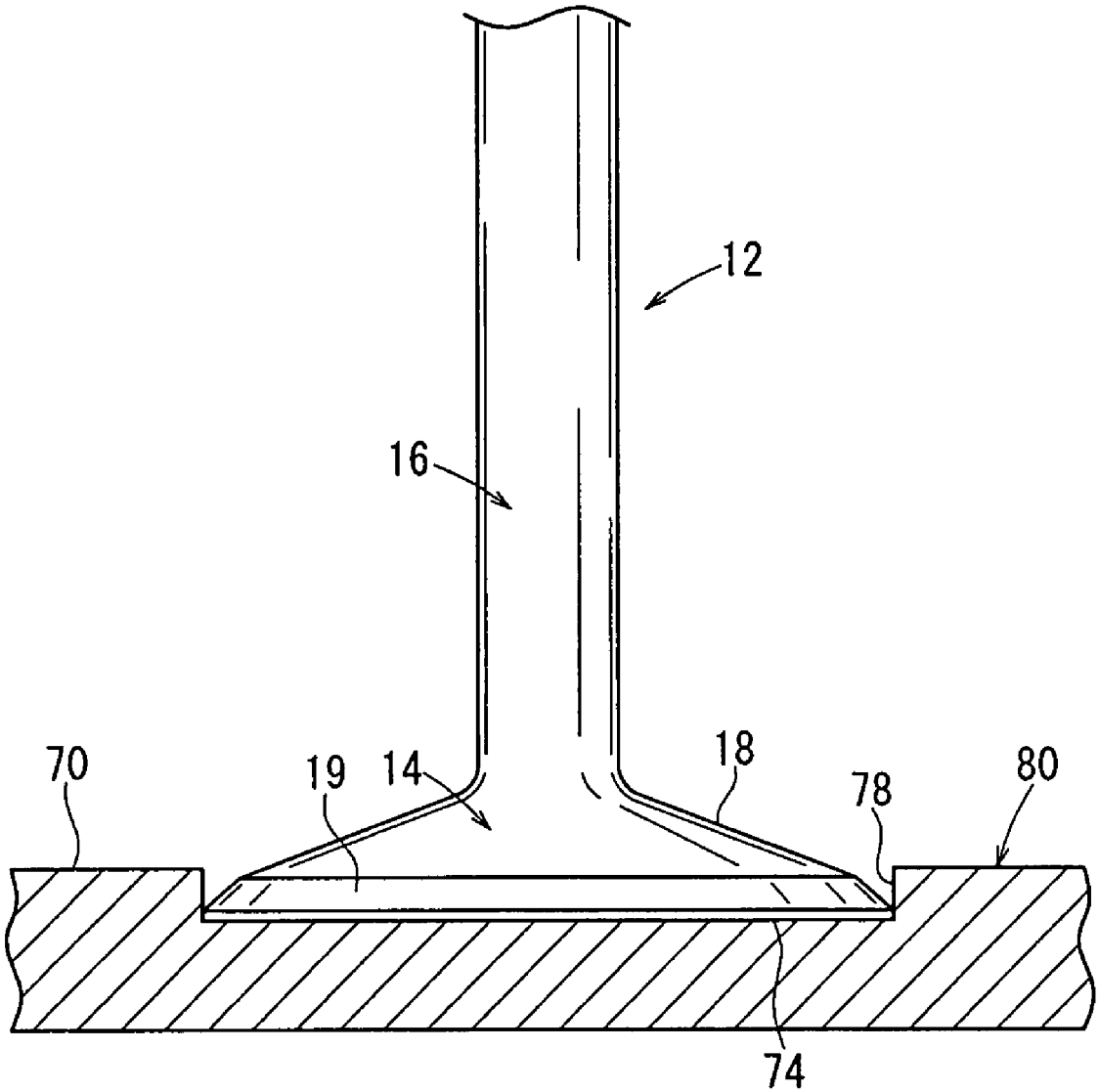
FIG. 14 is an enlarged vertical sectional view of a surface-modifying jig, which has a recess therein for placement of a valve head of an engine valve.

Further, as shown in FIG. 14, a surface-modifying jig 80, having a recess 78 dented a predetermined depth from the planar portion 70, may be employed, wherein the recess 78 receives and holds the valve head 14. Thus, the valve head 14 can be positioned in relation to the surface-modifying jig 80 while the valve head 14 is prevented from being displaced radially.

In these cases, the engine valve 12 is held such that the plane 74 of the valve head 14 is brought into surface contact with either the planar portion 70 of the surface-modifying jig 72 or the bottom surface of the recess 78 of the surface-modifying jig 80. This enables a larger contact area between the engine valve 12 and the surface-modifying jig 72, 80, thereby more reliably preventing discharged surface roughness or the like from occurring on the engine valve 12.

In any case, an anode may appropriately be located inside the heat treatment furnace, instead of the heat treatment furnace serving as an anode. With this arrangement, since the anode can be located at any position, a plasma can be generated at an effective position for promoting surface treatment. Specifically, if the anode is located near a position where high-density plasma is required, i.e., at a position where a surface-modifying treatment is required to be applied to the engine valve 12, the surface-modifying treatment can be performed more effectively. Further, in this case, advantageously, the surface treatment can be performed easily and at a low cost.

The invention claimed is:

1. A method for surface-modifying an engine valve while holding said engine valve formed of an iron group series alloy on a surface-modifying jig, said surface-modifying jig including a surface contact area, a head part of said engine valve being brought into contact with said surface contact area, and said contact being a surface contact, wherein said surface-modifying jig comprises an inclined portion, which is inclined in accordance with the shape of said head part of said engine valve, and wherein said inclined portion is brought into surface contact with said head part, said method comprising the steps of:

bringing said head part of said engine valve into contact with said surface contact area of said surface-modifying jig; and placing said surface-modifying jig inside a treatment furnace, and causing a discharge between a cathode and an anode in the presence of a flowing gas, thereby generating a plasma employing said gas as a source, wherein said surface-modifying jig or said engine valve serves as said cathode.

2. A method according to claim 1, further comprising the step of performing at least one of a hydrogen-sputtering and a nitriding treatment on said engine valve in the presence of said generated plasma.

3. A method according to claim 1, wherein said treatment furnace serves as said anode for causing said discharge.

4. A method for surface-modifying an engine valve while holding said engine valve formed of an iron group series alloy on a surface-modifying jig, said surface-modifying jig including a line contact area, a head part of said engine valve being brought into contact with said line contact area, and said contact being a line contact, wherein said surface-modifying jig comprises a ring portion, which is formed in an annular shape in accordance with the shape of said head part of said engine valve, and wherein said ring portion is brought into line contact with said head part, said method comprising the steps of:

bringing said head part of said engine valve into contact with said line contact area of said surface-modifying jig; and placing said surface-modifying jig inside a treatment furnace, and causing a discharge between a cathode and an anode in the presence of a flowing gas, thereby generating a plasma employing said gas as a source, wherein said surface-modifying jig or said engine valve serves as said cathode.

5. A method according to claim 4, further comprising the step of performing at least one of a hydrogen-sputtering and a nitriding treatment on said engine valve in the presence of said generated plasma.

6. A method according to claim 4, wherein said treatment furnace serves as said anode for causing said discharge.

7. A method for surface-modifying an engine valve while holding said engine valve formed of an iron group series alloy on a surface-modifying jig, said surface-modifying jig including a surface contact area, a rod part of said engine valve being brought into contact with said surface contact area, and said contact being a surface contact, wherein said surface-modifying jig comprises a cylinder portion, which has a shape in accordance with the shape of said rod part of said engine valve, and wherein said cylinder portion is brought into surface contact with an outer circumferential surface of said rod part, said method comprising the steps of:

bringing said rod part of said engine valve into contact with said surface contact area of said surface-modifying jig; and placing said surface-modifying jig inside a treatment furnace, and causing a discharge between a cathode and an anode in the presence of a flowing gas, thereby generating a plasma employing said gas as a source, wherein said surface-modifying jig or said engine valve serves as said cathode.

8. A method according to claim 7, further comprising the step of performing at least one of a hydrogen-sputtering and a nitriding treatment on said engine valve in the presence of said generated plasma.

9. A method according to claim 7, wherein said treatment furnace serves as said anode for causing said discharge.

* * * * *

UNITED STATES PATENT AND TRADEMARK OFFICE

CERTIFICATE OF CORRECTION

PATENT NO. : 7,892,364 B2
APPLICATION NO. : 11/666888
DATED : February 22, 2011
INVENTOR(S) : Tadao Baba et al.

It is certified that error appears in the above-identified patent and that said Letters Patent is hereby corrected as shown below:

ON THE TITLE PAGE:

At item (86), PCT No., change "PCT/JP2006/006036" to --PCT/JP2006/306036--.

Signed and Sealed this
Sixteenth Day of August, 2011

David J. Kappos

David J. Kappos
*Director of the United States Patent and Trademark Office*